United States Patent [19]

Kimura

[11] Patent Number: 4,610,634

[45] Date of Patent: Sep. 9, 1986

[54] CORD FOR RETAINING A SURFBOARD

[76] Inventor: Gen Kimura, 1-18-5, Higashi Nippora, Arakawa-ku, Tokyo, Japan

[21] Appl. No.: 706,941

[22] Filed: Mar. 1, 1985

[51] Int. Cl.[4] ..... A63C 15/06

[52] U.S. Cl. ..... 441/75

[58] Field of Search ..... 441/74, 75; 267/69; 114/205, 213, 215

[56] References Cited

U.S. PATENT DOCUMENTS

| | | | |
|---|---|---|---|
| 2,132,616 | 10/1938 | Hardie | 267/69 |
| 2,878,013 | 3/1959 | Piodi | 114/213 |
| 4,041,562 | 8/1977 | Nealy | 441/75 |
| 4,044,415 | 8/1977 | Wood | 441/75 |
| 4,285,083 | 8/1981 | Wilson | 441/75 |
| 4,462,116 | 7/1984 | Sanzone et al. | 2/171 |
| 4,479,785 | 10/1984 | Tugwood et al. | 441/75 |

OTHER PUBLICATIONS

Surfing Magazine, Power Cord, May 1980, vol. 16, No. 5.

*Primary Examiner*—Trygve M. Blix
*Assistant Examiner*—Stephen P. Avila
*Attorney, Agent, or Firm*—Holman & Stern

[57] ABSTRACT

The present invention aims at connecting one end of a surfboard and the ankle of a rider by a cord in a freely attachable/detachable manner at both ends, enabling the rider to detach the surfboard by a simple operation. The ankle strap and the cord tip are directly connected via a swivel mechanism to prevent entanglement of the two and twist of the cord, achieving excellent safety and operability as well as preventing accidents. A pocket to store small articles is provided to the ankle strap to allow the rider carry keys, coins, etc.

2 Claims, 6 Drawing Figures

CORD FOR RETAINING A SURFBOARD

DETAILED DESCRIPTION OF THE INVENTION

Extremely delicate sense of balance is required in manipulating a surfboard. When an external force of some kind is applied to an ankle of a rider while manipulating board, it will cause a fall, etc. Due to vertical and horizontal movements of waves, external forces in complex forms affect the rider, giving more impact than expected to both the rider and the board. Tensile strength and shearing power more than necessary are applied to a cord, tearing the cord and letting the board float away. A retaining cord using a swivel joint has been contrived in order to avoid such an accident. The swivel joint is interposed at the point where the cord and an ankle strap or a board protecting band, etc. are connected in order to prevent the cord from becoming entangled, twisted, or to prevent the tendency to bend in a certain direction while the board is being used. However, as the cord and the ankle strap are connected by means of strings at both ends of the swivel joint, strings or cords sometimes become entangled with the swivel joint itself, or with themselves, causing damage to the essential function of the swivel joint. The function to restore the twisted cord against the ankle strap is also often hampered since the swivel joint is mounted between the strings.

A retaining cord according to this invention has been contrived especially in view of such inconveniences of the prior art. Its first objective is to fix the swivel mechanism of the cord directly to the cord end and to the ankle strap in order to eliminate the need for the string so that twisted ankle strap and cord may be directly restored back to their proper positions, as well as to totally do away with the entanglement of strings with respect to the swivel mechanism.

The second objective is to make the swivel joint as simple as possible in order to reduce breakdowns and to cut down manufacturing and installing costs. The 3rd objective is to make the board and the cord freely detachable/attachable by a simple operation for easy storage and transport. The 4th objective is to provide a pocket for keeping keys of a car or a locker, coins, etc. which one must carry around.

Figure 1:
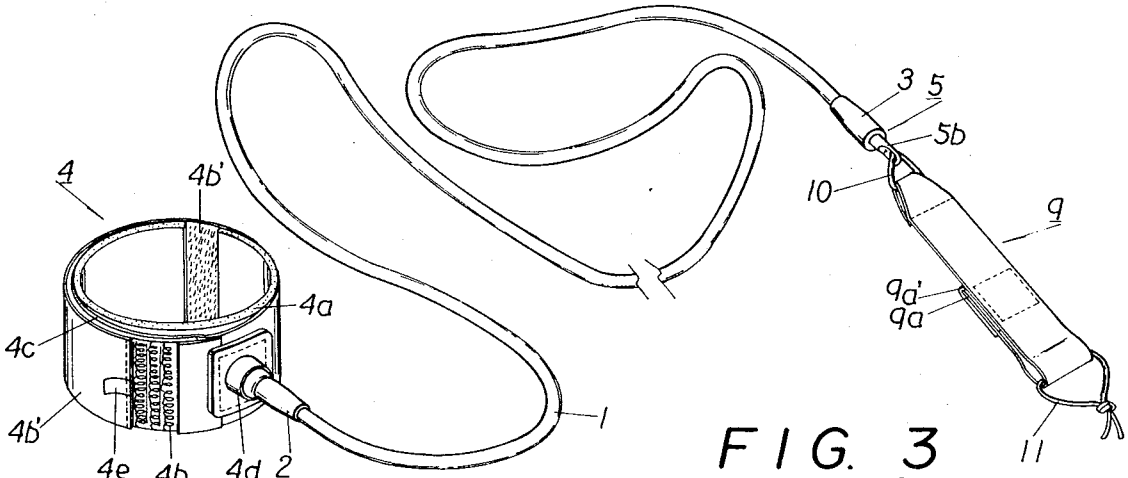
Figure 3:
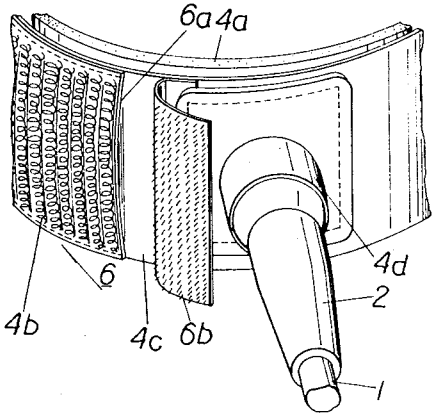
Figure 2:
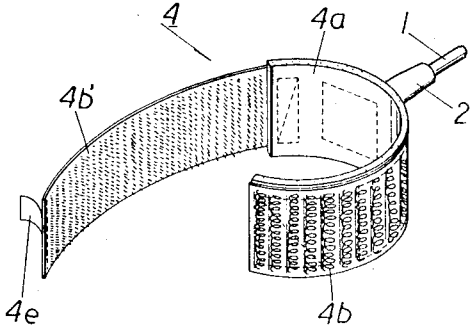
Figure 4:
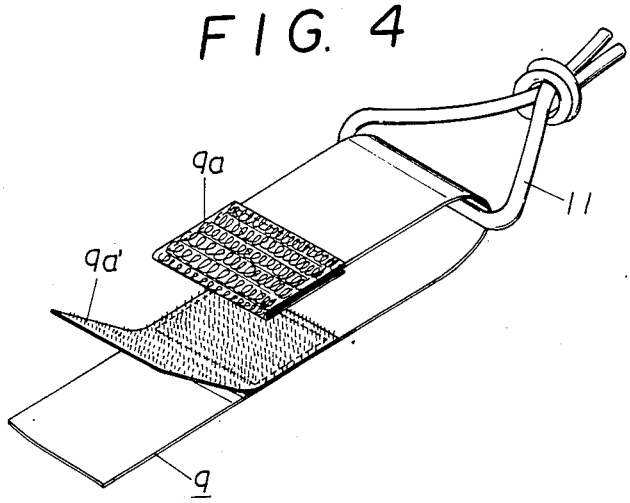
Figure 5:
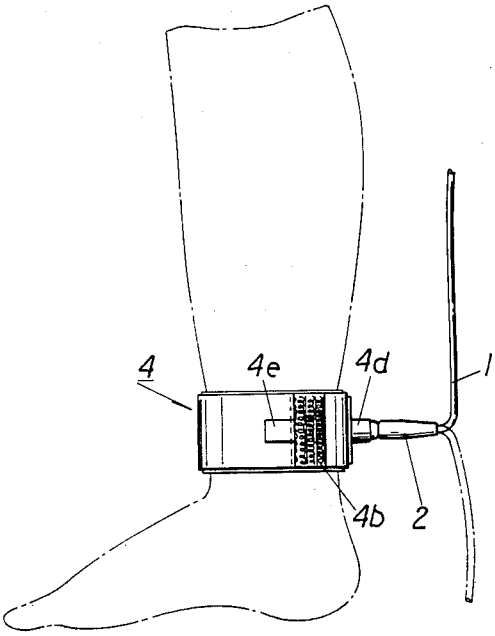
Figure 6:
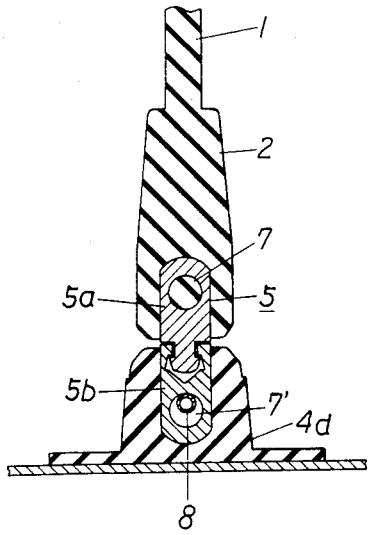

FIG. 1 is a perspective of an embodiment of a retaining cord of a surfboard according to this invention; FIG. 2 is a perspective of an ankle strap thereof; FIG. 3 is a perspective view of a connecting portion of the cord and a pocket for small articles at the ankle strap; FIG. 4 is a perspective view of the connecting portion of the surfboard retaining cord and a cusion material; FIG. 5 is a drawing to explain the rotational movement of the ankle strap and FIG. 6 is a cross section of the swivel joint when embedded.

An embodiment according to this invention is now explained in detail referring to the attached drawings.

Reference numeral 1 denotes a code made of such material as synthetic resin or rubber which is highly elastic and flexible and has excellent tensile strength. Attachments 2 and 3 which have bulged portions respectively are integrally fixed to both ends of said cord 1 respectively by means of thermal fusion or by using resin-type adhesives in most cases.

Reference numeral 4 denotes an ankle strap basically comprising a cusion material 4*a* made of neoprene and a velvet fastener 4*b* which is freely attachable/detachable. Said ankle strap 4 comprises a cusion strip 4*a* and a knit band 4*c* of synthetic fiber outside the cusion strip 4*a*. A face-to-face fastener 4*b* is sewn to the outside of the band 4*c*, at one end of which is attached an extended face-to-face fastener 4*b'* so that said band 4*c* can be wrapped around the ankle in a freely attachable/-detachable manner. At an open end of the face-to-face fastener 4*b'* is fixed one end of a synthetic fiber tape such as nylon to make a folded tongue 4*e*. The other end of the tongue 4*e* is protruded toward outside. This facilitates detachment of the face-to-face fastener 4*b'* from the face-to-face fastener 4*b*, and finding the open end of the face-to-face fastener 4*b'* quickly and easily in case of emergency underwater to unfasten the face-to-face fastener and remove the ankle strap 4 from the ankle.

An attachment member of synthetic resin 4*d* is projected at an arbitrary position on the outer periphery of the ankle strap 4. Said attachment 4*d* and aforementioned bulging attachment 2 are connected to the cord 1 in a freely rotatable manner by means of a metal connecting means. There is provided a bag-shaped pocket 6 with an opening 6*a* which is adjacent to the attachment 4*d*, between the band 4*c* and the face-to-face fastener 4*b* outside thereof. The opening 6*a* is so provided that it is covered by a tongue of the face-to-face fastener 6*b* in a freely openable manner. One end 5*a* of the connecting means 5 is embedded in the attachment 2. The same material which forms the attachment 2 fills the inside of an engagement bore 7. A pin hole is provided in said attachment 2, and a pin is inserted through said pin hole and the engagement bore 7. The other end 5*b* of the connecting means 5 is inserted into the attachment member 4*c* of the ankle strap and is connected by inserting a pin 8 from the pin hole of the attachment member 4*c* into the engagement bore 7' thereof.

Said connecting means is what is called a swivel joint, and the structure thereof is in no way restricted so long as the connecting portion is freely rotatable.

One end of said connecting means 5 is embedded in the bulging attachment member 3 on the side of the cord 1 which is connected to the surfboard. In this case, the other end 5*b* of the connecting means 5 is connected a cushion strip 9 via a loop-like string 10. Face-to-face fasteners 9*a*, 9*a'* are fixed to an open end and to the approximate center of said cushion strip 9 respectively. The open end is passed through the loop of the strip 11 which is connected to the board, folded back to the approximate center and fastened via fasteners 9*a* and 9*a'*. It is so structured that the board therefore is freely attachable/detachable and the cord may rotate independently when attached.

The retaining cord according to this invention succeeded in achieving various characteristics mentioned above due to the said structure. The bulging attachment 2, inter alia, is projected vertically relative to the strap 4 and a pair of metal fixtures 5 inserted in a freely rotatable manner with each other are provided between the cord 1 and the ankle strap 4, and the cord 1 and the cushion strip 9 respectively. This secures prevention of hazardous twist and entanglement between the cord 1 and the ankle strap 4, removes causes for unexpected force from outside, loss of balance, etc. when operating the board. It further prevents in advance accidents at the time of fall, especially that of entanglement by the cord, or floating away of the board therefrom. The board 1 and the cord 4 are made freely attachable/-detachable by means of the cushion strip 9, thereby allowing easy transport of the board as well as easy removal of the cord 1 when storing and easy attachment when in use, and enhances safety in emergency.

The pocket 6 is provided to the ankle strap 4 for storing and conveniently carrying around keys of the car, locker, coins, etc. By providing the opening of the pocket 6 adjacent to the attaching portion 4*d* of the cord, the position of the opening 6*a* may be easily recognized when in use.

I claim:

1. In a cord assembly for retaining a surfboard comprising a wide ankle strap band which is wrapped around the ankle of a rider in a freely attachable/-detachable manner and a cord of which one end is connected to said band while the other end is connected to the surfboard via a cushion strip, the improvement wherein the cord is connected to the band by an attachment member made of synthetic resin having a flange plate secured on the periphery of the ankle strap band and a head portion projecting outwardly from the flange plate, one of a pair of metal connecting members forming a swivel joint is embedded and fixed in the head portion of the attachment member while the other connecting member is embedded and fixed in an enlarged synthetic resin attachment provided at one end of the retaining cord, characterized in that said cushion strip is shaped like a band, connected to the cord, attached with face-to-face fasteners at an open end and center thereof respectively, the open end is passed through a loop-like string connected to the surfboard and then folded back to the center so as to engage the surfboard in a freely attachable/detachable manner using the face-to-face fasteners said ankle strap band comprises a band-shaped cushion material and a synthetic knit band on the outside thereof over which a face-to-face fastener is sewed while an extended face-to-face fastener is provided to one end of said band so as to make said fabric band wearable around the ankle in a freely attachable/-detachable manner, and that a bag-shaped pocket with an opening adjacent to the attachment member is provided between said fabric band and the face-to-face fastener thereof the opening being covered by the tongue of the fastener in a freely openable manner.

2. A retaining cord assembly as claimed in claim 1 wherein the connecting members are secured in the head portion of the attachment member and in the attachment by respective pin connections.

* * * * *